US010410596B2

(12) United States Patent
Chang et al.

(10) Patent No.: US 10,410,596 B2
(45) Date of Patent: Sep. 10, 2019

(54) GATE DRIVING CIRCUIT

(71) Applicant: Raydium Semiconductor Corporation, Hsinchu (TW)

(72) Inventors: Yao Tsung Chang, Hsinchu (TW); Chih Chuan Huang, Zhubei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 272 days.

(21) Appl. No.: 15/472,446

(22) Filed: Mar. 29, 2017

(65) Prior Publication Data

US 2017/0287426 A1 Oct. 5, 2017

(30) Foreign Application Priority Data

Apr. 1, 2016 (TW) ..... 105110622 A

(51) Int. Cl.
*G09G 3/36* (2006.01)

(52) U.S. Cl.
CPC ..... *G09G 3/3677* (2013.01); *G09G 3/3648* (2013.01); *G09G 2310/0218* (2013.01); *G09G 2310/08* (2013.01)

(58) Field of Classification Search
None
See application file for complete search history.

(56) References Cited

U.S. PATENT DOCUMENTS 6,373,458 B1 * 4/2002 Yamakura ..... G09G 3/3648 345/100

* cited by examiner

*Primary Examiner* — Duane N Taylor, Jr.

(57) ABSTRACT

A gate driving circuit including an input terminal, N delay units, a control signal bus, N buffer units and N output pads is disclosed. The input terminal receives a timing control signal including a total delay time. The N delay units are connected to the input terminal in order. Delay times of N delay units are adjustable and a sum of them is the total delay time. The control signal bus determines delay times of N delay units respectively according to the timing control signal. A first buffer unit of N buffer units is coupled between the input terminal and a first delay unit of N delay units; a second buffer unit, a third buffer unit . . . and an N-th buffer unit are coupled between two corresponding delay units respectively. The N output pads, correspondingly coupled to the N buffer units, output N gate driving signals respectively.

12 Claims, 3 Drawing Sheets

GATE DRIVING CIRCUIT

BACKGROUND OF THE INVENTION

1. Field of the Invention

This invention relates to a display, especially to a gate driving circuit applied to a display.

2. Description of the Prior Art

In the conventional liquid crystal display, when the liquid crystal display panel is at power-off state, the charges on the liquid crystal display panel will be discharged to avoid abnormal display screen. The timing controller (T-CON) will transmit a timing control signal (XON) to the gate driver to control all gate outputs. When the gate driver receives the timing control signal, the gate driver will control all gate outputs to drive all thin-film transistors (TFTs) on the liquid crystal display panel to discharge all charges stored in all pixels. This function can be called XON function.

Conventionally, the delay time used in the XON function is usually fixed; therefore, this fixed delay time fails to be used in all liquid crystal display panels having different sizes. If the delay time used in the XON function is too short, large inrush current generated will damage wire on array (WOA); if the delay time used in the XON function is too long, the voltage level of the power supply will be already decreased to the ground voltage and the XON function will be failed.

SUMMARY OF THE INVENTION

Therefore, the invention provides a gate driving circuit applied to a liquid crystal display to solve the above-mentioned problems.

An embodiment of the invention is a gate driving circuit. In this embodiment, the gate driving circuit is applied to a liquid crystal display. The gate driving circuit includes an input terminal, N delay units, a control signal bus, N buffer units and N output pads. The input terminal is configured to receive a timing control signal including a total delay time. The N delay units is connected to the input terminal in order, wherein delay times of the N delay units are adjustable and a sum of the delay times of the N delay units is the total delay time, wherein N is a positive integer and N≥2. The control signal bus is configured to determine the delay times of the N delay units respectively according to the timing control signal. The N buffer units includes a first buffer unit, a second buffer unit, . . . , and an N-th buffer unit, wherein the first buffer unit is coupled between the input terminal and a first delay unit of the N delay units; the second buffer unit, . . . , and the N-th buffer unit are coupled between two corresponding delay units of the N delay units respectively. The N output pads are correspondingly coupled to the N buffer units and configured to output N gate driving signals respectively.

In an embodiment, the total delay time is adjustable.

In an embodiment, the liquid crystal display further includes a timing controller coupled to the input terminal of the gate driving circuit and the timing control signal is generated by the timing controller.

In an embodiment, the liquid crystal display further includes a display panel having (N*M) rows of pixels, wherein M is a positive integer.

In an embodiment, the liquid crystal display includes M gate driving circuits, the N output pads of each gate driving circuit coupled to corresponding N rows of pixels of the (N*M) rows of pixels respectively output the N gate driving signals to the corresponding N rows of pixels.

Another embodiment of the invention is a gate driving circuit. In this embodiment, the gate driving circuit is applied to a liquid crystal display. The gate driving circuit includes an input terminal, N delay units, K control signal buses, N buffer units and N output pads. The input terminal is configured to receive a timing control signal including a total delay time. The N delay units includes a first delay unit, a second delay unit, . . . , a (N−1)-th delay unit and a N-th delay unit, wherein the first delay unit is coupled between the input terminal and the second delay unit; the second delay unit, . . . , a (N−1)-th delay unit and a N-th delay unit are connected in series to the first delay unit in order; delay times of the N delay units are adjustable and a sum of the delay times of the N delay units is the total delay time, the N delay units are divided into K delay unit groups, delay units in the same delay unit group have the same delay time; N and K are positive integers, N≥2 and N≥K. The K control signal buses are coupled to the K delay unit groups respectively and configured to determine the delay times of the K delay unit groups respectively according to the timing control signal. The N buffer units includes a first buffer unit, a second buffer unit, . . . , an (N−1)-th buffer unit and an N-th buffer unit, wherein the first buffer unit is coupled between the input terminal and the first delay unit, the second buffer unit is coupled between the first delay unit and the second delay unit, . . . , the N-th buffer unit is coupled between the (N−1)-th delay unit and the N-th delay unit. N output pads is correspondingly coupled to the N buffer units and configured to output N gate driving signals respectively.

Compared to the prior art, the gate driving circuit applied to the display of the invention uses adjustable delay time to realize the XON function; therefore, even the liquid crystal display panel of the display has different sizes, the delay time used in the XON function can be adjusted accordingly, so that the wire on array (WOA) will not be damaged due to the too short delay time and the XON function will not be failed due to the too long delay time. Therefore, the performance of the gate driving circuit applied to the display can be further enhanced.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is a gate driving circuit applied to a display. In this embodiment, the gate driving circuit is applied to a liquid crystal display, but not limited to this.

Figure 1:
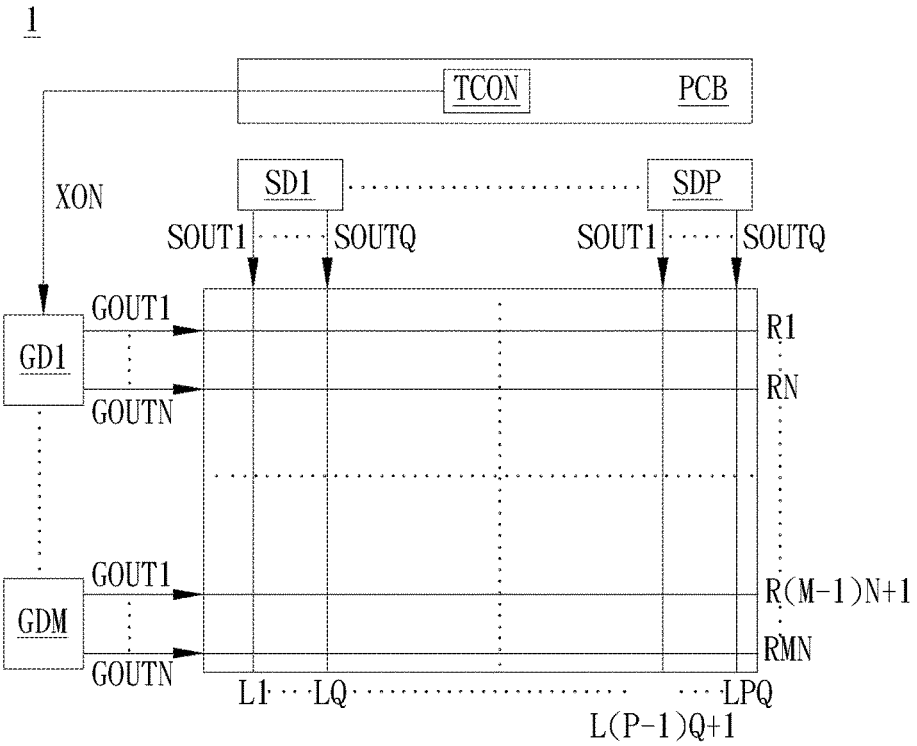
FIG. 1 illustrates a schematic diagram of the gate driving circuit applied in the display in a preferred embodiment of the invention.

Please refer to FIG. 1. FIG. 1 illustrates a schematic diagram of the gate driving circuit applied in the display in a preferred embodiment of the invention.

As shown in FIG. 1, the display 1 includes a display panel PL, a timing controller TCON, M gate driving circuits GD1~GDM and P source driving circuits SD1~SDP. Wherein, M and P are positive integers and M and P can be the same or different without specific limitations.

In this embodiment, the display panel PL includes (M*N)*(P*Q) pixels; the (M*N)*(P*Q) pixels are arranged as (M*N) rows of pixels R1~RMN along the horizontal direction and arranged as (P*Q) columns of pixels L1~LPQ along the vertical direction, wherein M, N, P and Q are positive integers, N≥2. Each pixel includes a transistor TR and a capacitor C, and the capacitor C is coupled to a drain of the transistor TR.

The timing controller TCON is disposed on a circuit board PCB and coupled to M gate driving circuits GD1~GDM. The timing controller TCON will generate a timing control signal XON and transmit the timing control signal XON to the M gate driving circuits GD1~GDM respectively.

As to the M gate driving circuits GD1~GDM, taking the gate driving circuit GD1 for example, the gate driving circuit GD1 is coupled to a first row of pixels R1~a N-th row of pixels RN of the (M*N) rows of pixels respectively. When the gate driving circuit GD1 receives the timing control signal XON from the timing controller TCON, the gate driving circuit GD1 will output N gate driving signals GOUT1~GOUTN to the first row of pixels R1~the N-th row of pixels RN respectively to drive the first row of pixels R1~the N-th row of pixels RN respectively. Similarly, the gate driving circuit GDM is coupled to a [(M−1)*N+1]-th row of pixels R(M−1)*N+1~a (M*N)-th row of pixels RMN of the (M*N) rows of pixels respectively. When the gate driving circuit GDM receives the timing control signal XON from the timing controller TCON, the gate driving circuit GDM will output N gate driving signals GOUT1~GOUTN to the [(M−1)*N+1]-th row of pixels R(M−1)*N+1~the (M*N)-th row of pixels RMN respectively to drive the [(M−1)*N+1]-th row of pixels R(M−1)*N+1~the (M*N)-th row of pixels RMN respectively.

It should be noticed that, taking the gate driving circuit GD1 for example, the gate driving signal GOUT1 outputted by the gate driving circuit GD1 will be transmitted to the gates of the transistors TR of all pixels in the first row of pixels R1; the gate driving signal GOUT2 outputted by the gate driving circuit GD1 will be transmitted to the gates of the transistors TR of all pixels in the second row of pixels R2, . . . and the gate driving signal GOUTN outputted by the gate driving circuit GD1 will be transmitted to the gates of the transistors TR of all pixels in the N-th row of pixels RN. Similarly, the gate driving signal GOUT1 outputted by the gate driving circuit GDM will be transmitted to the gates of the transistors TR of all pixels in the [(M−1)*N+1]-th row of pixels R(M−1)*N+1; the gate driving signal GOUT2 outputted by the gate driving circuit GDM will be transmitted to the gates of the transistors TR of all pixels in the [(M−1)*N+2]-th row of pixels R(M−1)*N+2, . . . and the gate driving signal GOUTN outputted by the gate driving circuit GDM will be transmitted to the gates of the transistors TR of all pixels in the (M*N)-th row of pixels RMN.

As to the P source driving circuits SD1~SDP, taking the source driving circuit SD1 for example, the source driving circuit SD1 is coupled to a first column of pixels L1~a Q-th column of pixels LQ of the (P*Q) columns of pixels respectively. The source driving circuit SD1 will output Q source driving signals SOUT1~SOUTQ to the first column of pixels L1~the Q-th column of pixels LQ respectively to drive the first column of pixels L1~the Q-th column of pixels LQ respectively. Similarly, the source driving circuit SDP is coupled to a [(P−1)*Q+1]-th column of pixels L(P−1)Q+1~a (P*Q)-th column of pixels LPQ of the (P*Q) columns of pixels respectively. The source driving circuit SDP will output the Q source driving signals SOUT1~SOUTQ to the [(P−1)*Q+1]-th column of pixels L(P−1)Q+1~the (P*Q)-th column of pixels LPQ respectively to drive the [(P−1)*Q+1]-th column of pixels L(P−1)Q+1~the (P*Q)-th column of pixels LPQ respectively.

It should be noticed that, taking the source driving circuit SD1 for example, the source driving signal SOUT1 outputted by the source driving circuit SD1 will be transmitted to the source electrodes of the transistors TR of all pixels in the first column of pixels L1, . . . and the source driving signal SOUTQ outputted by the source driving circuit SD1 will be transmitted to the source electrodes of the transistors TR of all pixels in the Q-th column of pixels LQ. Similarly, the source driving signal SOUT1 outputted by the source driving circuit SDP will be transmitted to the source electrodes of the transistors TR of all pixels in the [(P−1)*Q+1]-th column of pixels L(P−1)*Q+1, . . . and the source driving signal SOUTQ outputted by the source driving circuit SDP will be transmitted to the source electrodes of the transistors TR of all pixels in the (P*A)-th column of pixels LPQ.

Next, different embodiments will be introduced as follows to show the circuit structure of the gate driving circuit GD1 in this invention. It should be noticed that although the gate driving circuit GD1 is taken as example in the following embodiments, other gate driving circuits GD2~GDM are also similar to the gate driving circuit GD1.

Figure 2:
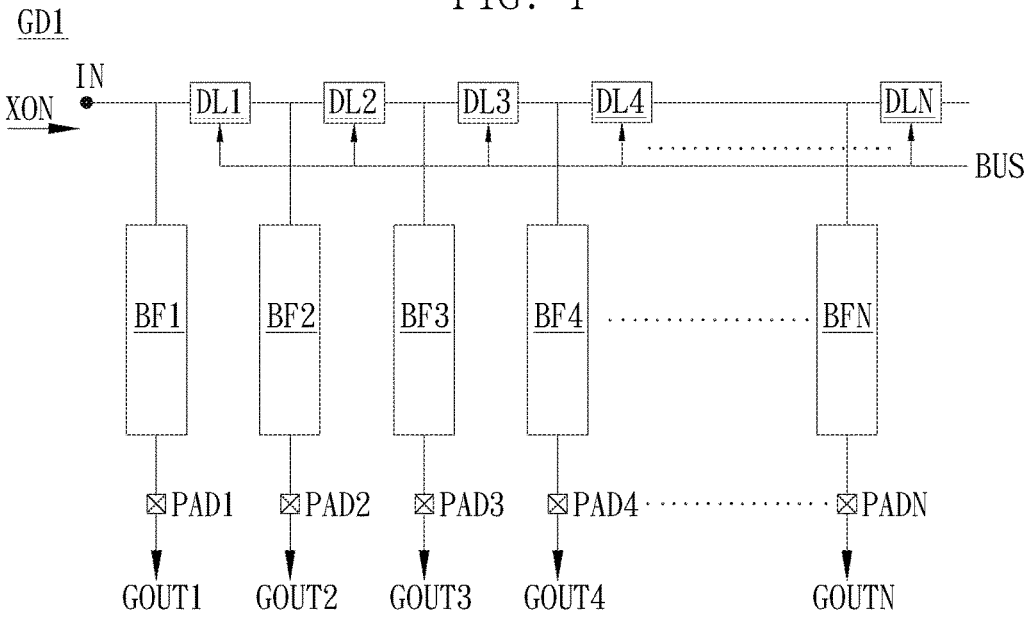
FIG. 2 illustrates a schematic diagram of the gate driving circuit having single control signal bus.

Please refer to FIG. 2. FIG. 2 illustrates a schematic diagram of the gate driving circuit having single control signal bus.

As shown in FIG. 2, the gate driving circuit GD1 includes an input terminal IN, N delay units DL1~DLN, a control signal bus BUS, N buffer units BF1~BFN and N output pads PAD1~PADN. The input terminal IN of the gate driving circuit GD1 is configured to receive a timing control signal XON from a timing controller TCON, wherein the timing control signal XON includes a total delay time.

In this embodiment, the N delay units DL1~DLN includes a first delay unit DL1, a second delay unit DL2, a third delay unit DL3, . . . , a (N−1)-th delay unit DL(N−1) and a N-th delay unit DLN. Wherein, the first delay unit DL1 is coupled between the input terminal IN and the second delay unit DL2; the second delay unit DL2, the third delay unit DL3, . . . , the (N−1)-th delay unit DL(N−1) and the N-th delay unit DLN are coupled in series to the first delay unit DL1 in order.

It should be noticed that the N delay units DL1~DLN of the gate driving circuit GD1 have their own delay times respectively, and all the delay times of the N delay units DL1~DLN are adjustable. In addition, a sum of the delay times of the N delay units DL1~DLN is the total delay time included in the timing control signal XON. Therefore, it can be found that the total delay time included in the timing control signal XON is also adjustable.

In this embodiment, the N buffer units BF1~BFN includes a first buffer unit BF1, a second buffer unit BF2, a third buffer unit BF3, . . . , a (N−1)-th buffer unit BF(N−1) and an N-th buffer unit BFN. The N output pads PAD1~PADN includes a first output pad PAD1, a second output pad PAD2, a third output pad PAD3, . . . , a (N−1)-th output pad PAD(N−1) and an N-th output pad PADN. One terminal of the first buffer unit BF1 is coupled between the input terminal IN and the first delay unit DL1 and another terminal of the first buffer unit BF1 is coupled to the first output pad PAD1; one terminal of the second buffer unit BF2 is coupled between the first delay unit DL1 and the second delay unit DL2 and another terminal of the second buffer unit BF2 is coupled to the second output pad PAD2; . . . ; similarly, one terminal of the N-th buffer unit BFN is coupled between the (N−1)-th delay unit DL(N−1) and the N-th delay unit DLN and another terminal of the N-th buffer unit BFN is coupled to the N-th output pad PADN. The control signal bus BUS is coupled to the N delay units DL1~DLN respectively to determine the delay times of the N delay units DL1~DLN respectively according to the timing control signal XON. The N output pads PAD1~PADN are correspondingly coupled to the N buffer units BF1~BFN to output N gate driving signals GOUT1~GOUTN respectively.

Figure 3:
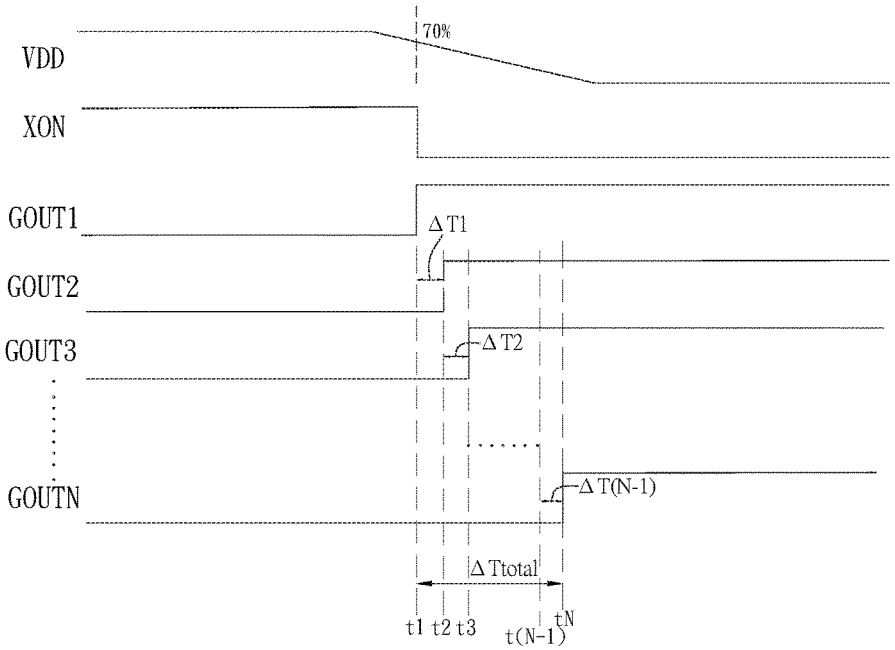
FIG. 3 illustrates a timing diagram of the timing control signal XON and N gate driving signals GOUT1~GOUTN.

Please also refer to FIG. 3. FIG. 3 illustrates a timing diagram of the timing control signal XON and N gate driving signals GOUT1~GOUTN.

As shown in FIG. 3, when the operating voltage VDD from the power supply is decreased from original high-level and decreased to a certain proportion (e.g., 70%) of the high-level at a first time t1, the voltage level of the timing control signal XON will be changed from original high-level to low-level and maintained at the low-level. As to the N gate driving signals GOUT1~GOUTN, the N gate driving signals GOUT1~GOUTN will be changed from original low-level to high-level at different times t1~tN in order according to their own delay times respectively and maintained at the high-level.

In detail, the gate driving signal GOUT1 will change its voltage level at the first time t1 synchronized with the timing control signal XON; however, the difference is that the timing control signal XON is changed from original high-level to low-level and maintained at low-level, and the gate driving signal GOUT1 is changed from original low-level to high-level and maintained at high-level. Therefore, at the first time t1, among the N gate driving signals GOUT1~GOUTN, only the gate driving signal GOUT1 is at high-level and other gate driving signals GOUT2~GOUTN are still at original low-level.

Then, after the delay time ΔT1 from the first time t1, the gate driving signal GOUT2 is changed from original low-level to high-level and maintained at high-level at the second time t2. Therefore, at the second time t2, among the N gate driving signals GOUT1~GOUTN, only the gate driving signals GOUT1 and GOUT2 are at high-level and other gate driving signals GOUT3~GOUTN are still at original low-level.

Similarly, after the delay time ΔT2 from the second time t2, the gate driving signal GOUT3 is changed from original low-level to high-level and maintained at high-level at the third time t3. Therefore, at the third time t3, among the N gate driving signals GOUT1~GOUTN, only the gate driving signals GOUT1~GOUT3 are at high-level and other gate driving signals GOUT4~GOUTN are still at original low-level.

So on and so forth, after the delay time ΔT(N−1) from the (N−1)-th time t(N−1), the gate driving signal GOUTN is changed from original low-level to high-level and maintained at high-level at the N-th time tN. Therefore, at the N-th time tN, all of the N gate driving signals GOUT1~GOUTN are at high-level and no gate driving signal is at original low-level.

It should be noticed that the above-mentioned delay times ΔT1~ΔT(N−1) are all adjustable and a sum of them is the total delay time ΔTtotal included in the timing control signal XON; therefore, the total delay time ΔTtotal included in the timing control signal XON is also adjustable.

Figure 4:
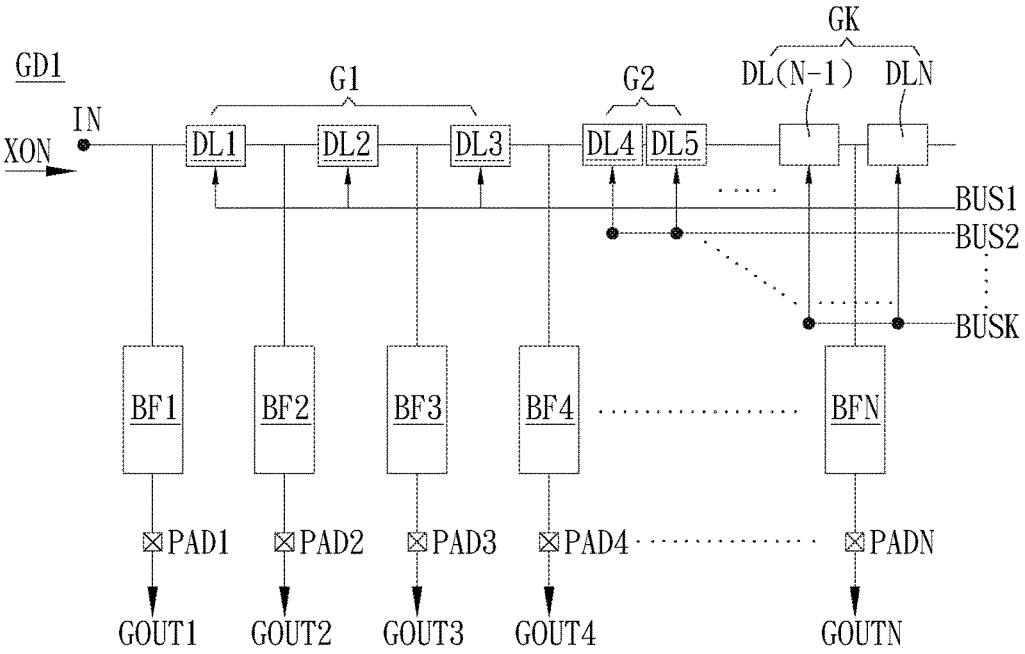
FIG. 4 illustrates a schematic diagram of the gate driving circuit having multiple control signal buses.

Please refer to FIG. 4. FIG. 4 illustrates a schematic diagram of the gate driving circuit having multiple control signal buses.

As shown in FIG. 4, the gate driving circuit GD1 includes an input terminal IN, N delay units DL1~DLN, K control signal buses BUS1~BUSK, N buffer units BF1~BFN and N output pads PAD1~PADN. The input terminal IN of the gate driving circuit GD1 is configured to receive a timing control signal XON from a timing controller TCON, wherein the timing control signal XON includes a total delay time. N and K are positive integers, and N≥2, N≥K.

In this embodiment, the N delay units DL1~DLN includes a first delay unit DL1, a second delay unit DL2, a third delay unit DL3, . . . , a (N−1)-th delay unit DL(N−1) and a N-th delay unit DLN. Wherein, the first delay unit DL1 is coupled between the input terminal IN and the second delay unit DL2; the second delay unit DL2, the third delay unit DL3, . . . , the (N−1)-th delay unit DL(N−1) and the N-th delay unit DLN are coupled in series to the first delay unit DL1 in order. The N buffer units BF1~BFN includes a first buffer unit BF1, a second buffer unit BF2, a third buffer unit BF3, . . . , a (N−1)-th buffer unit BF(N−1) and an N-th buffer unit BFN. The N output pads PAD1~PADN includes a first output pad PAD1, a second output pad PAD2, a third output pad PAD3, . . . , a (N−1)-th output pad PAD(N−1) and an N-th output pad PADN. One terminal of the first buffer unit BF1 is coupled between the input terminal IN and the first delay unit DL1 and another terminal of the first buffer unit BF1 is coupled to the first output pad PAD1; one terminal of the second buffer unit BF2 is coupled between the first delay unit DL1 and the second delay unit DL2 and another terminal of the second buffer unit BF2 is coupled to the second output pad PAD2; . . . ; similarly, one terminal of the N-th buffer unit BFN is coupled between the (N−1)-th delay unit DL(N−1) and the N-th delay unit DLN and another terminal of the N-th buffer unit BFN is coupled to the N-th output pad PADN.

The difference between this embodiment and the above-mentioned embodiment is that the N delay units are divided into K delay unit groups, and delay units in the same delay unit group have the same delay time. The K control signal buses BUS1~BUSK are coupled to the K delay unit groups G1~GK respectively and configured to determine the delay times of the K delay unit groups G1~GK respectively according to the timing control signal XON.

It should be noticed that the delay times of the K delay unit groups G1~GK are all adjustable and a sum of them is the total delay time ΔTtotal included in the timing control signal XON. Therefore, the total delay time ΔTtotal included in the timing control signal XON is also adjustable.

In this embodiment, it is assumed that the first delay unit group G1 includes delay units DL1~DL3, the second delay unit group G2 includes delay units DL4~DL5, . . . , and the K-th delay unit group GK includes delay units DL(N−1)~DLN; the control signal bus BUS1 is coupled to the delay units DL1~DL3 of the first delay unit group G1 respectively to determine a first delay time for the delay units DL1~DL3 of the first delay unit group G1 according to the timing control signal XON; the control signal bus BUS2 is coupled to the delay units DL4~DL5 of the second delay unit group G2 respectively to determine a second delay time for the delay units DL4~DL5 of the second delay unit group G2 according to the timing control signal XON; so on and so forth, the control signal bus BUSK is coupled to the delay units DL(N−1)~DLN of the K-th delay unit group GK respectively to determine a K-th delay time for the delay units DL(N−1)~DLN of the K-th delay unit group GK according to the timing control signal XON. The N output pads PAD1~PADN are correspondingly coupled to the N buffer units BF1~BFN respectively to output N gate driving signals GOUT1~GOUTN respectively.

Figure 5:
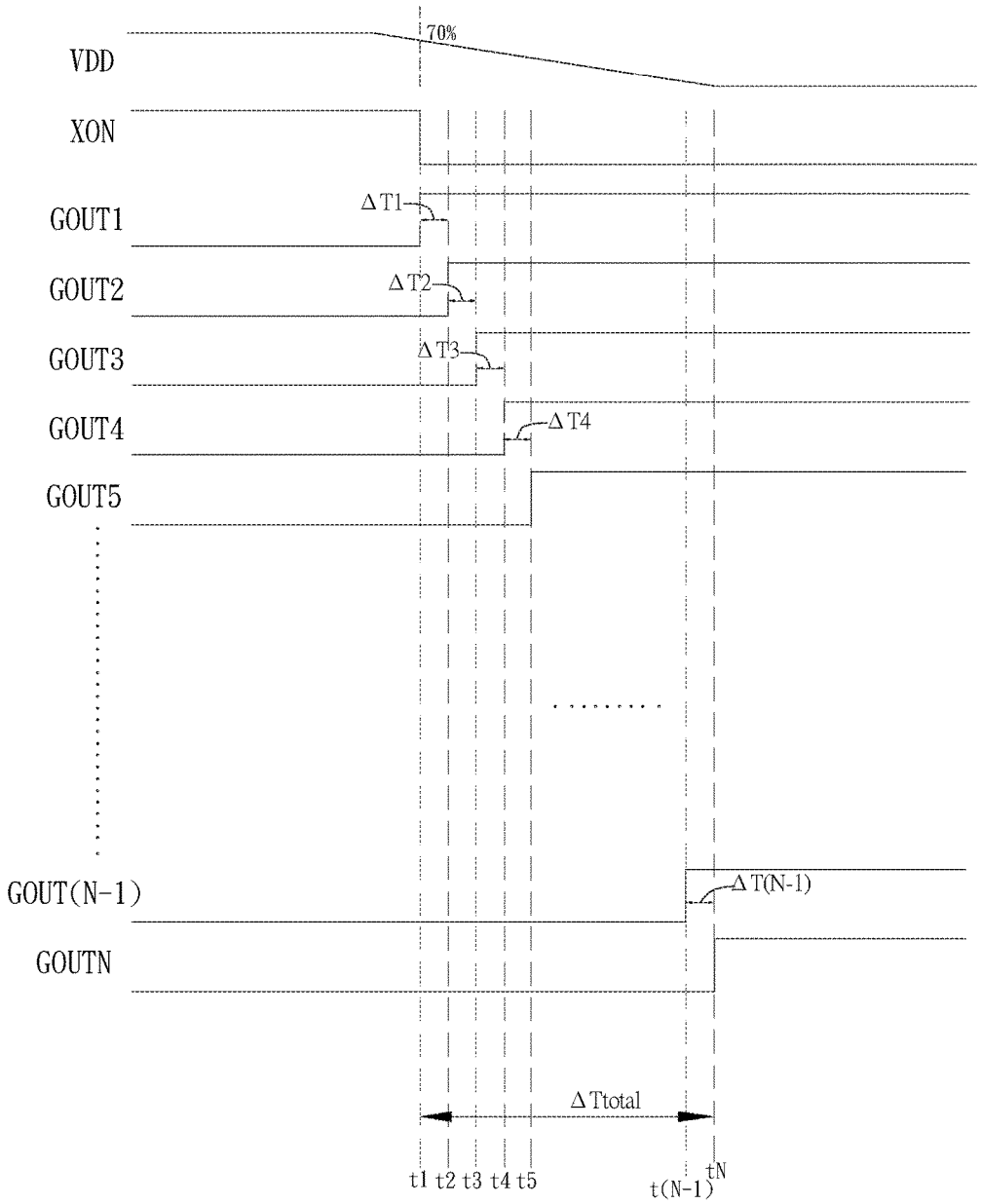
FIG. 5 illustrates a timing diagram of the timing control signal XON and (N+M) gate driving signals GOUT1~GOUT(N+M).

Please also refer to FIG. 5. FIG. 5 illustrates a timing diagram of the timing control signal XON and (N+M) gate driving signals GOUT1~GOUT(N+M).

As shown in FIG. 5, when the operating voltage VDD from the power supply is decreased from original high-level and decreased to a certain proportion (e.g., 70%) of the high-level at a first time t1, the voltage level of the timing control signal XON will be changed from original high-level to low-level and maintained at the low-level. As to the N gate driving signals GOUT1~GOUTN, the N gate driving signals GOUT1~GOUTN will be changed from original low-level to high-level at different times t1~tN in order according to delay times corresponding to different delay unit groups respectively and maintained at the high-level.

In detail, the gate driving signal GOUT1 will change its voltage level at the first time t1 synchronized with the timing control signal XON; however, the difference is that the timing control signal XON is changed from original high-level to low-level and maintained at low-level, and the gate driving signal GOUT1 is changed from original low-level to high-level and maintained at high-level. Therefore, at the first time t1, among the N gate driving signals GOUT1~GOUTN, only the gate driving signal GOUT1 is at high-level and other gate driving signals GOUT2~GOUTN are still at original low-level.

Then, after the delay time ΔT1 from the first time t1, the gate driving signal GOUT2 is changed from original low-level to high-level and maintained at high-level at the second time t2. Therefore, at the second time t2, among the N gate driving signals GOUT1~GOUTN, only the gate driving signals GOUT1 and GOUT2 are at high-level and other gate driving signals GOUT3~GOUTN are still at original low-level.

Similarly, after the delay time ΔT2 from the second time t2, the gate driving signal GOUT3 is changed from original low-level to high-level and maintained at high-level at the third time t3. Therefore, at the third time t3, among the N gate driving signals GOUT1~GOUTN, only the gate driving signals GOUT1~GOUT3 are at high-level and other gate driving signals GOUT4~GOUTN are still at original low-level.

Similarly, after the delay time ΔT3 from the third time t3, the gate driving signal GOUT4 is changed from original low-level to high-level and maintained at high-level at the fourth time t4. Therefore, at the fourth time t4, among the N gate driving signals GOUT1~GOUTN, only the gate driving signals GOUT1~GOUT4 are at high-level and other gate driving signals GOUT5~GOUTN are still at original low-level.

It should be noticed that since the delay units DL1~DL3 belong to the same delay unit group G1, the delay units DL1~DL3 will have the same delay time; that is to say, the delay times ΔT1~ΔT3 in FIG. 4 should be the same.

So on and so forth, after the delay time ΔT(N−2) from the (N−2)-th time t(N−2), the gate driving signal GOUT(N−1) is changed from original low-level to high-level and maintained at high-level at the (N−1)-th time t(N−1). Therefore, at the (N−1)-th time t(N−1), the gate driving signals GOUT1~GOUT(N−1) among the N gate driving signals GOUT1~GOUTN are at high-level and only one gate driving signal GOUTN is still at original low-level.

Then, after the delay time ΔT(N−1) from the (N−1)-th time t(N−1), the gate driving signal GOUTN is changed from original low-level to high-level and maintained at high-level at the N-th time tN. Therefore, at the N-th time tN, all N gate driving signals GOUT1~GOUTN are at high-level and no gate driving signal is at original low-level.

It should be noticed that the above-mentioned delay times ΔT1~ΔT(N−1) are all adjustable and a sum of them is the total delay time ΔTtotal included in the timing control signal XON; therefore, the total delay time ΔTtotal included in the timing control signal XON is also adjustable.

Compared to the prior art, the gate driving circuit applied to the display of the invention uses adjustable delay time to realize the XON function; therefore, even the liquid crystal display panel of the display has different sizes, the delay time used in the XON function can be adjusted accordingly, so that the wire on array (WOA) will not be damaged due to the too short delay time and the XON function will not be failed due to the too long delay time. Therefore, the performance of the gate driving circuit applied to the display can be further enhanced.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A gate driving circuit, applied to a liquid crystal display, comprising:

an input terminal configured to receive a timing control signal including a total delay time;

N delay circuits configured to be connected to the input terminal in order, wherein delay times of the N delay circuits are adjustable and a sum of the delay times of the N delay circuits is the total delay time, wherein N is a positive integer and N≥2;

a control signal bus configured to determine the delay times of the N delay circuits respectively according to the timing control signal;

N buffer circuits comprising a first buffer circuit, a second buffer circuit, . . . , and an N-th buffer circuit, wherein the first buffer circuit is coupled between the input terminal and a first delay circuit of the N delay circuits; the second buffer circuit, . . . , and the N-th buffer circuit are coupled between two corresponding delay circuits of the N delay circuits respectively; and N output pads, correspondingly coupled to the N buffer circuits, configured to output N gate driving signals respectively.

2. The gate driving circuit of claim 1, wherein the total delay time is adjustable.

3. The gate driving circuit of claim 1, wherein the liquid crystal display further comprises a timing controller coupled to the input terminal of the gate driving circuit and the timing control signal is generated by the timing controller.

4. The gate driving circuit of claim 1, wherein the liquid crystal display further comprises a display panel having (N*M) rows of pixels, wherein M is a positive integer.

5. The gate driving circuit of claim 4, wherein the liquid crystal display comprises M gate driving circuits, the N output pads of each gate driving circuit coupled to corresponding N rows of pixels of the (N*M) rows of pixels respectively output the N gate driving signals to the corresponding N rows of pixels.

6. A gate driving circuit, applied to a liquid crystal display, comprising:

an input terminal configured to receive a timing control signal including a total delay time;

N delay circuits comprising a first delay circuit, a second delay circuit, . . . , a (N−1)-th delay circuit and a N-th delay circuit, wherein the first delay circuit is coupled between the input terminal and the second delay circuit; the second delay circuit, ..., a (N−1)-th delay circuit and a N-th delay circuit are connected in series to the first delay circuit in order; delay times of the N delay circuits are adjustable and a sum of the delay times of the N delay circuits is the total delay time, the N delay circuits are divided into K delay circuit groups, delay circuits in the same delay circuit group have the same delay time; N and K are positive integers, N≥2 and N≥K;

K control signal buses, coupled to the K delay circuit groups respectively, configured to determine the delay times of the K delay circuit groups respectively according to the timing control signal;

N buffer circuits comprising a first buffer circuit, a second buffer circuit, . . . , an (N−1)-th buffer circuit and an N-th buffer circuit, wherein the first buffer circuit is coupled between the input terminal and the first delay circuit, the second buffer circuit is coupled between the first delay circuit and the second delay circuit, . . . , the N-th buffer circuit is coupled between the (N−1)-th delay circuit and the N-th delay circuit; and N output pads, correspondingly coupled to the N buffer circuits, configured to output N gate driving signals respectively.

7. The gate driving circuit of claim 6, wherein the total delay time is adjustable.

8. The gate driving circuit of claim 6, wherein at least two of the K delay circuit groups comprise the same number of delay circuits.

9. The gate driving circuit of claim 6, wherein each delay circuit group comprises different number of delay circuits.

10. The gate driving circuit of claim 6, wherein the liquid crystal display further comprises a timing controller coupled to the input terminal of the gate driving circuit and the timing control signal is generated by the timing controller.

11. The gate driving circuit of claim 6, wherein the liquid crystal display further comprises a display panel having (N*M) rows of pixels, wherein M is a positive integer.

12. The gate driving circuit of claim 11, wherein the liquid crystal display comprises M gate driving circuits, the N output pads of each gate driving circuit coupled to corresponding N rows of pixels of the (N*M) rows of pixels respectively output the N gate driving signals to the corresponding N rows of pixels.

* * * * *